US006429888B1

(12) United States Patent
Taki et al.

(10) Patent No.: US 6,429,888 B1
(45) Date of Patent: Aug. 6, 2002

(54) HEAT SENSITIVE TYPE PRINTER

(75) Inventors: Tomoko Taki; Hideyuki Kokubo, both of Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/021,015

(22) Filed: Dec. 19, 2001

(30) Foreign Application Priority Data

Dec. 22, 2000 (JP) ..... 2000-390979

(51) Int. Cl.[7] ..... B41J 29/377; B41J 2/32
(52) U.S. Cl. ..... 347/223; 347/175
(58) Field of Search ..... 347/171, 172, 347/175, 223; 400/120.01, 120.02, 120.03

(56) References Cited

FOREIGN PATENT DOCUMENTS

JP 6-239022 * 8/1994 ..... B41J/29/377
JP 7-148947 * 6/1995 ..... B41J/29/377

* cited by examiner

*Primary Examiner*—Huan Tran
(74) *Attorney, Agent, or Firm*—Sughrue Mion, PLLC

(57) ABSTRACT

There is disclosed a heat sensitive type printer wherein glass plates (36, 37, 38) are secured at one ends to thermal heads (26, 27, 28), and extend substantially in parallel to a paper transport path of a heat sensitive color recording paper (14). Surface luminous devices (31, 32) for fixing coloring layers of the recording paper optically are disposed adjacent to heat sinks of the thermal heads with their light emission surfaces facing the paper transport path through the glass plates. Cooling fans send air into between the heat sinks and the surface luminous devices, to cool the heat sinks. Thereafter, the air guide guides the air to flow along a gap between the light emission surface and the glass plate, thereby to cool the light emission surface.

8 Claims, 3 Drawing Sheets

HEAT SENSITIVE TYPE PRINTER

BACKGROUND OF THE INVENTION

1. Field of the Invention

The present invention relates to a heat sensitive type printer, and more particularly to a cooling fan of the heat sensitive type printer, that is provided for cooling a thermal head and a surface luminous device for optical fixing.

2. Background Arts

The heat sensitive type printer records an image on a heat sensitive recording paper that develops colors when it is heated, by heating the heat sensitive recording paper through a thermal head while moving the heat sensitive recording paper relative to the thermal head. Heat sensitive type color printers for recording full-color images use a heat sensitive color recording paper that has a heat sensitive cyan coloring layer, a heat sensitive magenta coloring layer and a heat sensitive yellow coloring layer which are formed atop another sequentially from a base material. These heat sensitive coloring layers have different heat sensitivities so that these coloring layers may develop colors sequentially from the most sensitive layer, that is, from the topmost layer to the bottommost layer. To stop the already colored coloring layer from being colored by the heat energy applied for coloring the next coloring layer, the already colored coloring layer is optically fixed by electromagnetic rays of a specific wavelength range prior to the heating for the next coloring layer.

There are mainly two types of heat sensitive type color printers: single-head three-pass type and three-head one-pass type. In the single-head three-pass type, the heat sensitive recording paper is passed by a single thermal head three times per one full-color image, to recorded in a three-color frame sequential fashion. In the three-head one-pass type, three thermal head for yellow, magenta and cyan are disposed at appropriate intervals along a transport path of the heat sensitive recording paper, and an optical fixing device for yellow is disposed between the yellow thermal head and the magenta thermal head, whereas an optical fixing device for magenta is disposed between the magenta thermal head and the cyan thermal head.

While the heat sensitive recording paper is being transported in a forward direction, that is, from the side of the thermal head for yellow to the thermal head for cyan, an yellow frame of a full-color image is recorded on the topmost yellow coloring layer, and then the yellow coloring layer is fixed by ultraviolet rays from the yellow optical fixing device. Thereafter while transporting the heat sensitive recording paper still in the forward direction, a magenta frame of the full-color image is recorded on the next magenta coloring layer by applying higher heat energies than those applied for the yellow recording, and the magenta coloring layer is fixed by ultraviolet rays from the magenta optical fixing device. Thereafter, a cyan frame of the full-color image is recorded on the cyan coloring layer by applying higher heat energies than those applied for the magenta recording. In this way, the full-color image is formed on the heat sensitive recording paper as the paper is transported once in the forward direction.

As the optical fixing devices, there are tubular ultraviolet lamps and surface luminous devices. The surface luminous device has a flat light emission surface that is placed to face the heat sensitiv[0085] recordin paper. Luminous intensity of these ultraviolet light sources is affected by the temperature. Specifically, the luminous intensity increases with an increase in temperature of the lamp tube, but above a certain temperature level, the luminous intensity begins to decrease.

If the luminous intensity of the optical fixing device varies during the optical fixation, the coloring layer is not uniformly fixed. For this reason, a cooling fan has conventionally been used for keeping the tube temperature in a given range in order to keep the luminous intensity constant.

Concerning the surface luminous device, however, it has been difficult to cool the light emission surface uniformly just by blowing cold air from lateral sides of the light emission surface. Since the light emitting surface of the planer ultraviolet light emitting device extends across the width of the heat sensitive recording paper, that is, in a transverse direction to the paper transporting direction, the method of sending cooling air from the lateral side results unevenness in surface temperature of the light emission surface, and thus unevenness in the optical fixation, particularly in the widthwise direction of the heat sensitive recording paper. Using a lot of cooling fans for uniform cooling results in rising the cost and the size of the heat sensitive type printer. Moreover, the cold air blowing the light emission surface can cool the heat sensitive recording paper and cause unexpected temperature variations of the heat sensitive recording paper, which results improper coloring densities. Also because the cold air can dry the heat sensitive recording paper, and the change in moistness of the heat sensitive recording paper affects the coloring characteristics of the heat sensitive recording paper, it is necessary to prevent the cold air from blowing the heat sensitive recording paper.

SUMMARY OF THE INVENTION

In view of the foregoing, an object of the present invention is to provide a heat sensitive type printer that efficiently cools a planer light source without affecting the coloring density of the heat sensitive recording paper.

A heat sensitive type printer according to the present invention comprises a paper transporting device for transporting a heat sensitive recording paper along a paper transport path, the heat sensitive recording paper having at least a coloring layer; at least a thermal head having a heating element array extending in a transverse direction to the paper transport path, the thermal head heating the heat sensitive recording paper through the heating element array as the heat sensitive recording paper is transported along the paper transport path, to record an image line by line on the coloring layer; at least a surface luminous device having a plane light emission surface that faces the paper transport path, for radiating electromagnetic rays toward the heat sensitive recording paper, to fix the coloring layer after having the image recorded thereon; and at least a cooling device for cooling the thermal head and the surface luminous device, the cooling device comprising a cooling air generating device that sends air toward the thermal head and the surface luminous device, and an air guide that guides the cooling air to flow along the light emission surface of the surface luminous device in a lengthwise direction of the paper transport path, to cool the light emission surface.

Since the air that cools the thermal head or the light emission surface of the surface luminous device also cools the other of the thermal head and the light emission surface, both of the thermal head and the light emission surface the single cooling device are cooled with efficiency. Since the air guide guides the cooling air to flow along the light emission surface in the lengthwise direction of the paper transport path, the cooling air is prevented from blowing the heat sensitive recording paper, and thus from influencing the temperature and the moisture of the recording paper.

According to a preferred embodiment, the thermal head and the surface luminous device are disposed adjacent to each other, and the cooling air generating device is disposed above the thermal head and the surface luminous device, and causes the cooling air to flow between the thermal head and the surface luminous device. The air guide is a light permeable plate having one end secured to the thermal head and extending between the light emission surface and the paper transport path substantially in parallel to the paper transport path, so as to conduct the cooling air along a gap between the light emission surface and the air guide.

BRIEF DESCRIPTION OF THE DRAWINGS

The above and other objects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE EMBODIMENTS

Figure 1:
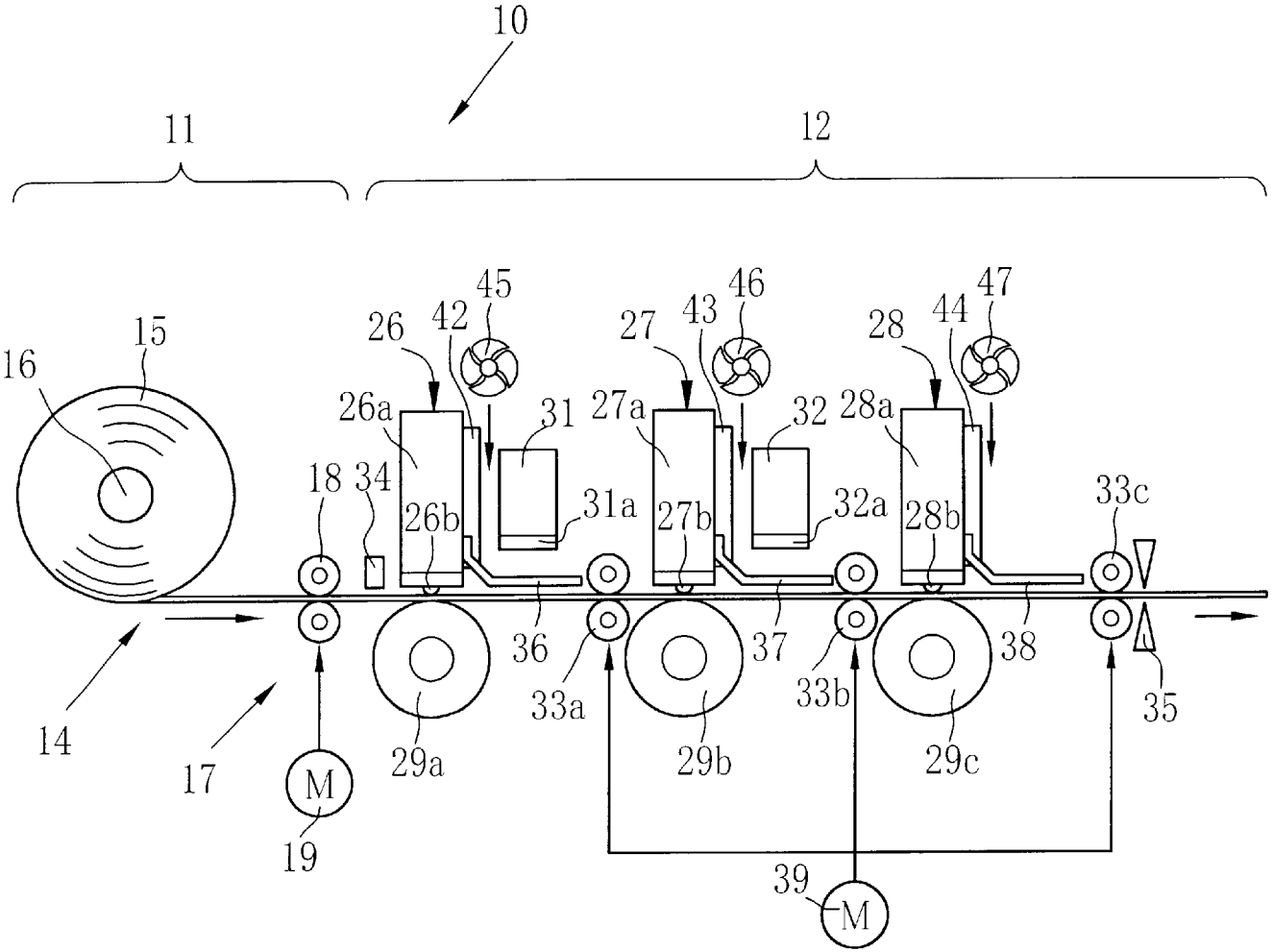
FIG. 1 is a schematic diagram illustrating a three-head one-pass type heat sensitive color printer according to an embodiment of the present invention.

A three-head one-pass type heat sensitive color printer 10 shown in FIG. 1 consists of a paper supply section 11 and an image recording section 12. In the paper supply section 11, a roll 15 of heat sensitive color recording paper 14 is rotatably held on a rotary shaft 16. A paper supply mechanism 17 consists of paper supply rollers 18 and a pulse motor 19 for driving the paper supply roller 18. The paper supply rollers 18 nip and pull out the heat sensitive recording paper 14 from the roll 15, to feed it to the image recording section 12. Rotational movement of the pulse motor 19 is controlled by a not-shown system controller.

Figure 2:
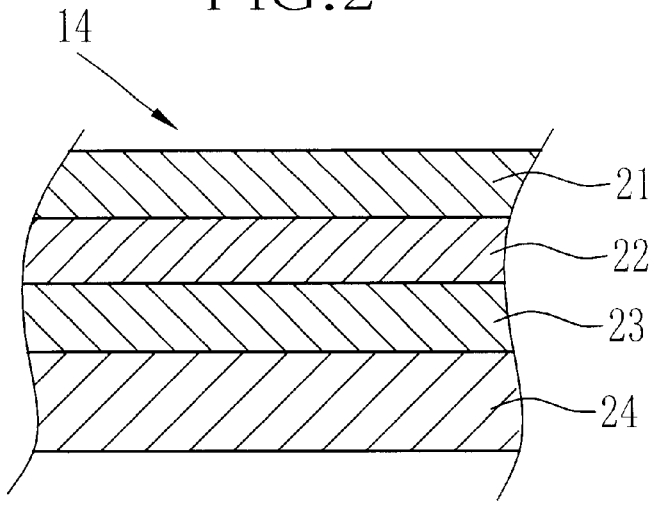
FIG. 2 is an explanatory diagram illustrating a layered structure of a heat sensitive color recording paper.

As shown in FIG. 2, the heat sensitive recording paper 14 has a heat sensitive yellow coloring layer 21, a heat sensitive magenta coloring layer 22 and a heat sensitive cyan coloring layer 23 formed atop another on a base material 24, in this order from an obverse side opposite to the base material 24. The topmost yellow coloring layer 21 has the highest heat sensitivity, whereas the bottommost cyan coloring layer 23 has the lowest heat sensitivity. The yellow coloring layer 21 loses its coloring ability when exposed to ultraviolet rays around 420 nm, whereas the magenta coloring layer 22 loses its coloring ability when exposed to ultraviolet rays around 365 nm.

The image recording section 12 is constituted of a yellow recording thermal head 26, a magenta recording thermal head 27, a cyan recording thermal head 28, platen rollers 29*a*, 29*b* and 29*c*, a yellow fixing device 31 with a planer light emission surface 31*a*, a magenta fixing device 32 with a planer light emission surface 32*a*, conveyer rollers 33*a*, 33*b* and 33*c*, a leading edge sensor 34, a cutter 35 and other minor elements.

The thermal heads 26, 27 and 28 are arranged along a paper passageway at regular intervals, and the platen rollers 29*a*, 29*b* and 29*c* are respectively placed across the paper passageway from the thermal heads 26, 27 and 28. The conveyer rollers 33*a* to 33*c* are disposed respectively behind the thermal heads 26 to 28, and are driven by a pulse motor 39 to convey the heat sensitive recording paper 14 through the paper passageway in a forward direction indicated by arrows.

Rotational movement of the pulse motor 39 is controlled by the system controller. The leading edge sensor 34 is located between the paper supply rollers 18 and the platen roller 29*a*, to output a detection signal to the system controller upon detection of a leading edge of the heat sensitive recording paper 14. The system controller starts counting drive pulses applied to the pulse motors 19 and 39, to measure the advanced length of the heat sensitive recording paper 14, for determining a printing start position, a paper cutting position and other positions of the heat sensitive recording paper 14. The cutter 35 cuts the heat sensitive recording paper 14 into a designated length after a full-color image is printed thereon.

The thermal heads 26 to 28 are of vertical type where head base frames 26*a*, 27*a* and 28*a* are oriented vertical to the heat sensitive recording paper 14. A heating element array 26*b*, 27*b* or 28*b* is formed on a bottom of each of the thermal heads 26 to 28. The heating element arrays 26*b* to 28*b* are each constituted of a large number of heating elements aligned in a main scan direction that is a widthwise direction of the heat sensitive recording paper 14 as conveyed along the paper passageway. The heat sensitive recording paper 14 is nipped between the heating element arrays 26*b* to 28*b* and the platen rollers 29*a* to 29*c*, so the platen rollers 29*a* to 29*c* rotate following to the conveying movement of the heat sensitive recording paper 14. While being in tight contact with the heat sensitive recording paper 14, each of the heating element arrays 26*b* to 28*b* heats the heat sensitive recording paper 14, thereby to record a line of color dots at a time across the width of the heat sensitive recording paper 14. As the heat sensitive recording paper 14 is conveyed, the thermal heads 26, 27 and 28 record a yellow frame, a magenta frame and a cyan frame of a full-color image line by line on the corresponding coloring layers 21, 22 and 23, sequentially from this order.

The thermal heads 26 to 28 have heat sinks 42, 43 and 44 provided on one sides thereof, and cooling fans 45, 46 and 47 are disposed above the heat sinks 42 to 44 for sending air to the heat sinks 42 to 44. Thus, the heat sinks 42 to 44 and the cooling fans 45 to 47 cool the head bodies.

The surface luminous device 31 for yellow is placed between the thermal head 26 and the thermal head 27, and the surface luminous device 32 for magenta is placed between the thermal head 27 and the thermal head 28, with their light emitting surfaces 31*a* and 32*a* oriented to the paper passageway. The surface luminous device 31 for yellow and the surface luminous device 32 for magenta are located closer to the heat sinks 42 and 43 of the thermal heads 26 and 27 respectively. Although it is not shown in the drawings, each of the surface luminous devices 31 and 32 is constituted of an ultraviolet radiating section and a filter that filters the ultraviolet rays from the radiating section, and lets pass only rays of a specific wavelength range necessary for the optical fixation of the yellow coloring layer 21 or the magenta coloring layer 22. Because the heat sensitivity of the cyan coloring layer 23 is so low that the cyan coloring layer 23 would not usually develop color under normal preservation, the printer is not provided with an optical fixing device for the cyan coloring layer 23.

The radiating section is provided with a light emitting element array consisting of a large number of light emitting elements arranged in a matrix, and radiates ultraviolet rays of around a wavelength range from 365 nm to 420 nm. The filter used in the surface luminous device 31 for yellow lets pass the ultraviolet rays around 420 nm that fix the yellow coloring layer 21, whereas the filter used in the surface luminous device 32 for magenta lets pass the ultraviolet rays around 365 nm that fix the magenta coloring layer 22. It is alternatively possible to omit the filters, and use those light emitting elements radiating the ultraviolet rays of around 420 nm in the surface luminous device 31 for yellow, and those radiating the ultraviolet rays of around 365 nm in the surface luminous device 32 for magenta.

Figure 3:
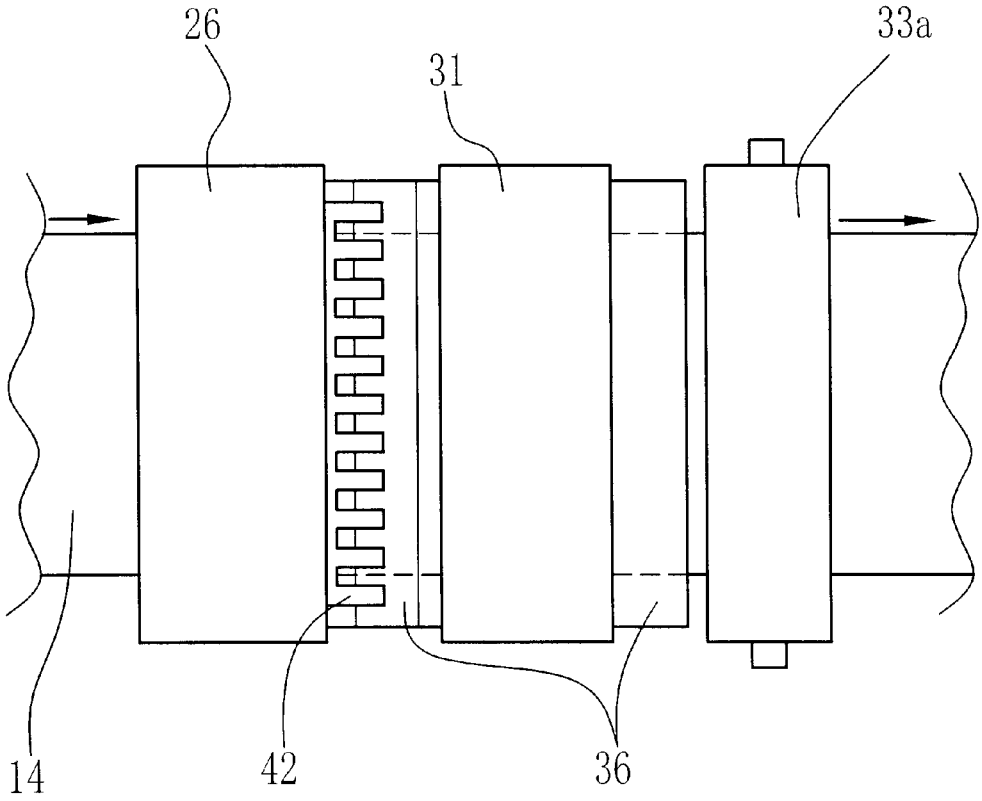
FIG. 3 is a top plan view of a yellow recording section of the printer.

Light permeable glass plates 36, 37 and 38 having a substantially L-shape are securely mounted on the one sides of the thermal heads 26, 27 and 28 respectively. Free ends of the glass plates 36 to 38 extend in parallel to the paper passageway, to serve as guide plates for the heat sensitive recording paper 14. The free ends of the glass plates 36 and 37 respectively extend underneath the light emitting surfaces 31*a* and 32*a*. A diagonal surface is formed in the corner of each glass plate 36, 37 and 38, for the sake of guiding the cool air into between the light emitting surface 31*a* or 32*a* and the free end of the glass plate 36 or 37. As shown in FIG. 3, the glass plate 36 is wider than the heat sensitive recording paper 14 and extend to the vicinity of the roller pair 33*a* as placed behind the thermal head 26. The same applies to the glass plate 37 with regard to the magenta recording section.

The printer having the above structures operates as follows:

In an initial position where the printer 10 is not activated, the heating element arrays 26*a*, 27*a* and 28*a* of the thermal heads 26, 27 and 28 are removed from the platen rollers 29*a*, 29*b* and 29*c*. When a print start command is entered by operating a not-shown print start key of the printer 10, the system controller turns on the surface luminous device 31 for yellow and the surface luminous device 32 for magenta, and drives the paper supply mechanism 17 to feed out the heat sensitive recording paper 14 from the roll 15 into between the thermal head 26 and the platen roller 29*a* of the image recording section 12. When the leading edge of the heat sensitive recording paper 14 comes to the leading edge sensor 34, the leading edge sensor 34 outputs a detection signal to the system controller. Then the system controller starts counting the drive pulses applied to the pulse motors 19 and 39. Thereafter when the system controller determines based on the count that the leading edge of the heat sensitive recording paper 14 comes into between the roller pair 33*a*, the system controller stops conveying the heat sensitive recording paper 14 and nips the heat sensitive recording paper 14 between the heating element array 26*b* of the thermal head 26 and the platen roller 29*a*, to start recording a yellow frame on the yellow coloring layer 21 by applying heat energies in accordance with yellow image.

When a first line of the yellow frame is recorded, the heat sensitive recording paper 14 is conveyed in the forward direction by a length corresponding to one main scanning line, and a second line of the yellow frame is recorded. In this way, the yellow frame is recorded line after line as the heat sensitive recording paper 14 is conveyed along the paper passageway. When the paper portion having the yellow frame comes under the surface luminous device 31 for yellow, the yellow coloring layer 21 is fixed by the ultraviolet rays from the light emitting surface 31*a*.

Thereafter when the leading edge of the heat sensitive recording paper 14 reaches the second roller pair 33*b*, the heat sensitive recording paper 14 is nipped between the heating element array 27*b* of the thermal head 27 and the platen roller 29*b*. When a leading end of the recorded yellow frame reaches the thermal head 27, the thermal head 27 starts recording a magenta frame on the magenta coloring layer 22 by applying heat energies in accordance with magenta image. The magenta frame is recorded line after line in synchronism with the conveying movement of the heat sensitive recording paper 14, in the same way as for the yellow frame. The paper portion having the magenta frame as well as the yellow frame recorded thereon comes under the surface luminous device 32 for magenta, the magenta coloring layer 22 is fixed by the ultraviolet rays from the light emitting surface 32*a*.

Thereafter when the leading edge of the heat sensitive recording paper 14 reaches the third roller pair 33*c*, the heat sensitive recording paper 14 is nipped between the heating element array 28*b* of the thermal head 28 and the platen roller 29*c*. In the same way as for the yellow and magenta frames, the thermal head 28 records a cyan frame line by line on the cyan coloring layer 23 by applying heat energies in accordance with cyan image, such that the cyan frame is recorded in the same area as the yellow and magenta frames. Thus a full-color image consisting of the three color frames is recorded on the heat sensitive recording paper 14.

After the full-color image is recorded in this way, the conveyer rollers 33*a* to 33*c* continue rotating to convey the heat sensitive recording paper 14 in the forward direction. When a cutting position behind a trailing end of the full-color image reaches the cutter 35, the conveyer rollers 33*a* to 33*c* stops and the cutter 35 is activated to cut off the image recorded paper portion. Thereafter, the conveyer rollers 33*a* to 33*c*, the paper supply rollers 18 and the rotary spool 16 are rotated in the reversed direction, to wind back the heat sensitive recording paper 14 onto the roll 15 till a new leading edge of the heat sensitive recording paper 14 is detected by the leading edge sensor 34.

During the above printing process, the cooling fans 45 to 47 send cool air along the one sides of the respective thermal heads 26 to 28 toward the heat sensitive recording paper 14, thereby cooling the heat sinks 42 to 44 as provided on these sides. Since heat energies accumulated in the thermal heads 26 to 28 are transmitted to the heat sinks 42 to 44, the thermal heads 26 to 28 are cooled by cooling the heat sinks 42 to 44. As a result, the heating elements are cooled down to an appropriate temperature range after each driving period thereof, so the heat accumulation in the thermal head does not affects the heat energies applied from the heating elements to the heat sensitive recording paper 14. Thus, the image is recorded at proper densities, and blank margins around the image would not be colored by extraneous heat energies from the thermal heads 26 to 28.

After cooling the heat sinks 42 to 44, the cool air flows from the cooling fans 45 to 47 are turned by the glass plates 36 to 38 to a direction parallel to the paper conveying direction that is the lengthwise direction of the heat sensitive recording paper 14, thereby cooling the light emitting surfaces 31*a* and 32*a*. Since the glass plates 36 to 38 shield the heat sensitive recording paper 14 from the cool air, the heat sensitive recording paper 14 would not be dried by the cool air, preventing the variation in the coloring characteristics of the heat sensitive recording paper 14 that could be caused by the variation in moistness of the heat sensitive recording paper 14. As being light-permeable, the glass plates 36 to 38 do not block the ultraviolet rays from the surface luminous devices 31 and 32, nor hinder the optical fixation of the heat sensitive recording paper 14.

The glass plates 36 to 38 may be replaced by plates made of another light permeable material, like acrylic plates. Instead of the cooling fans 45 to 47 that send the cool air from above the thermal heads down to the light emitting surfaces, it is possible to use ventilators that suck air so that the cooling air flows from the light emitting surface through the heat sink up to the ventilator.

Figure 4:
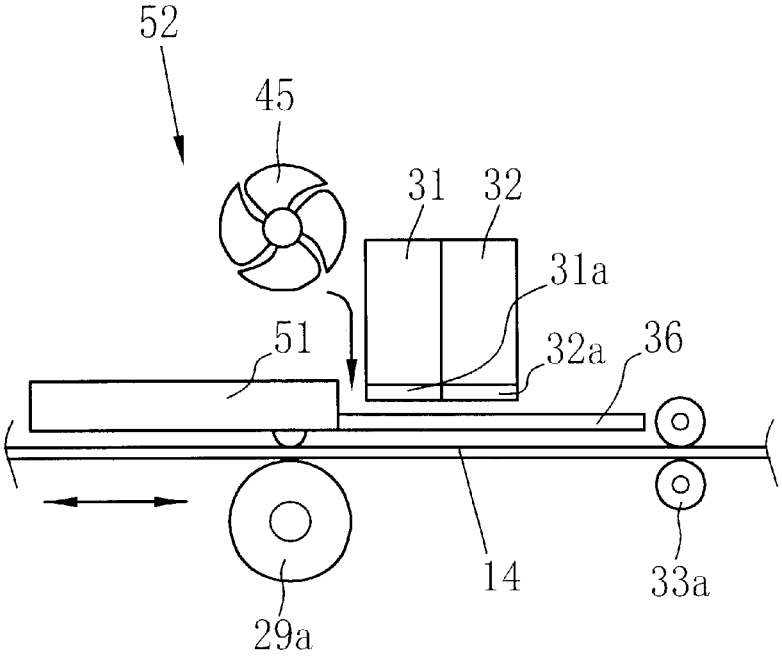
FIG. 4 is a schematic diagram illustrating essential parts of a single head three-pass type heat sensitive color printer according to another embodiment of the present invention.
Figure 5:
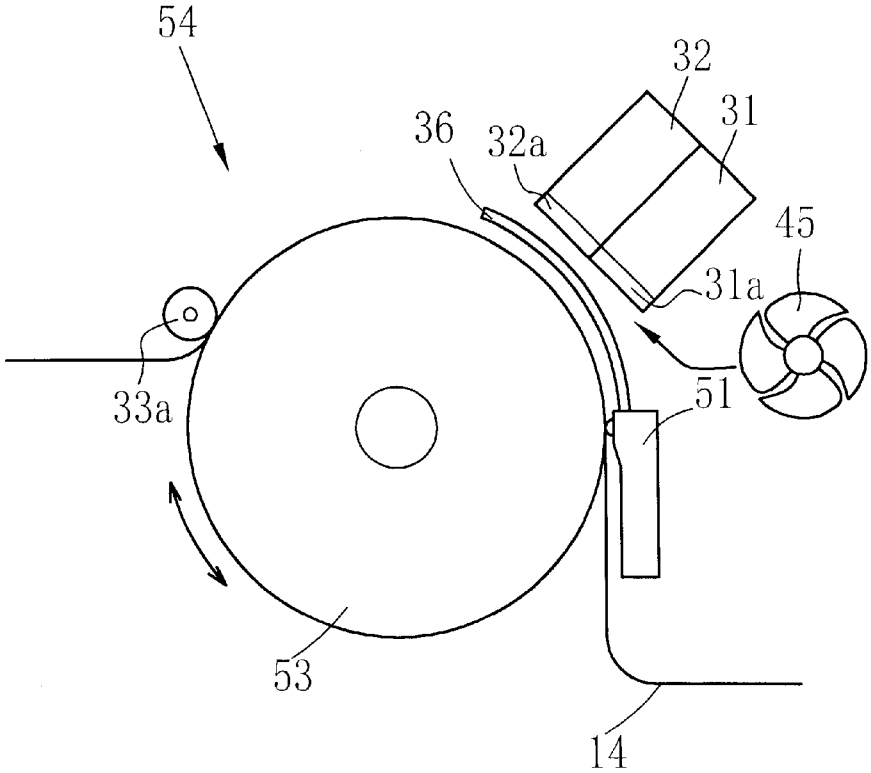
FIG. 5 is a schematic diagram illustrating essential parts of a platen drum type heat sensitive color printer according to a further embodiment of the present invention.

Although the present invention has been described with reference to the three-head one-pass type heat sensitive color printer 10 using the vertical thermal heads 26 to 28, the present invention is applicable to other types of heat sensitive type printers. For example, in a single-head three-pass type printer 52 using a horizontal thermal head 51, as shown in FIG. 4, wherein the surface luminous device 31 for yellow and the surface luminous device 32 for magenta are disposed adjacent to each other, and a light permeable glass plate 36 extends underneath these surface luminous devices 31 and 32, so as to block the cooling air from the heat sensitive recording paper 14. Although the heat sensitive recording paper 14 is transported along the straight-linear paper transport path in the first and second embodiments, the present invention is applicable to a platen drum type heat sensitive color printer 54, as shown in FIG. 5, where the heat sensitive recording paper 14 is transported along the circumference of a platen drum.

The present invention is also applicable to a heat sensitive type printer for printing a monochromatic image on a heat sensitive recording paper having a single coloring layer.

Thus, the present invention is not to be limited to the above embodiment but, on the contrary, various modifications will be possible to those skilled in the art without departing from the scope of claims attached hereto.

What is claimed is:

1. A heat sensitive type printer comprising:

a paper transporting device for transporting a heat sensitive recording paper along a paper transport path, said heat sensitive recording paper having at least a coloring layer;

at least a thermal head having a heating element array extending in a transverse direction to the paper transport path, said thermal head heating said heat sensitive recording paper through said heating element array as said heat sensitive recording paper is transported along the paper transport path, to record an image line by line on said coloring layer;

at least a surface luminous device having a plane light emission surface that faces the paper transport path, for radiating electromagnetic rays toward said heat sensitive recording paper, to fix said coloring layer after having said image recorded thereon; and at least a cooling device for cooling said thermal head and said surface luminous device, said cooling device comprising a cooling air generating device that sends air toward said thermal head and said surface luminous device, and an air guide that guides the cooling air to flow along said light emission surface of said surface luminous device in a lengthwise direction of said paper transport path.

2. A heat sensitive type printer as recited in claim 1, wherein said thermal head and said surface luminous device are disposed adjacent to each other, and said cooling air generating device is disposed above said thermal head and said surface luminous device, and causes the cooling air to f low between said thermal head and said surface luminous device.

3. A heat sensitive type printer as recited in claim 2, wherein said air guide is a light permeable plate having one end secured to said thermal head and extending between said light emission surface and the paper transport path substantially in parallel to the paper transport path, so as to conduct the cooling air along a gap between said light emission surface and said air guide.

4. A heat sensitive type printer as recited in claim 3, wherein said air guide is a transparent glass plate.

5. A heat sensitive type printer as recited in claim 3, wherein said thermal head comprises a head base frame oriented vertical to the paper transport path, and a heat sink formed on one vertical side of said head base frame, and wherein said surface luminous device is disposed adjacent to said heat sink.

6. A heat sensitive type printer as recited in claim 5, wherein said cooling air generating device is a fan that sends the air into between said heat sink and said surface luminous device, so the air after cooling said heat sink flows into the gap between said air guide and said light emission surface.

7. A heat sensitive type printer as recited in claim 5, wherein said heat sensitive type printer is a color printer for printing a full-color image in a three-color frame sequential fashion on a heat sensitive color recording paper having three coloring layers, and comprises three thermal heads arranged along the paper transport path for recording three color frames respectively on said three coloring layers, and two surface luminous devices arranged between said three thermal heads for fixing two of said three coloring layers, and wherein said cooling device is provided in connection to each of said thermal heads.

8. A heat sensitive type printer as recited in claim 3, wherein said heat sensitive type printer is a color printer having a single thermal head for printing a full-color image in a three-color frame sequential fashion on a heat sensitive color recording paper having three coloring layers while transporting said heat sensitive color recording paper a plurality of times through the paper transport path, and comprises two surface luminous devices arranged adjacent to each other along the paper transport path for fixing two of said three coloring layers, and wherein said cooling device is disposed in proximity to said thermal head such that said air guide extends underneath said light emission surfaces of said two surface luminous devices.

* * * * *